US011677175B2

(12) United States Patent
Shen et al.

(10) Patent No.: US 11,677,175 B2
(45) Date of Patent: Jun. 13, 2023

(54) ELECTRICAL CONNECTING ASSEMBLY AND ELECTRICAL CONNECTOR

(71) Applicant: Xuancheng Luxshare Precision Industry Co., Ltd., Xuancheng (CN)

(72) Inventors: RongXin Shen, Xuancheng (CN); XingRan Tang, Xuancheng (CN); YunBo Linghu, Xuancheng (CN)

(73) Assignee: Xuancheng Luxshare Precision Industry Co., Ltd., Xuancheng (CN)

( * ) Notice: Subject to any disclaimer, the term of this patent is extended or adjusted under 35 U.S.C. 154(b) by 0 days.

(21) Appl. No.: 17/501,645

(22) Filed: Oct. 14, 2021

(65) Prior Publication Data

US 2022/0384979 A1 Dec. 1, 2022

(30) Foreign Application Priority Data

May 26, 2021 (CN) ..... 202110578586.X

(51) Int. Cl.
*H01R 13/17* (2006.01)

(52) U.S. Cl.
CPC ..... *H01R 13/17* (2013.01)

(58) Field of Classification Search
CPC ..... H01R 13/17
See application file for complete search history.

(56) References Cited

U.S. PATENT DOCUMENTS 7,150,660 B2 * 12/2006 Allgood ..... H01R 13/113 439/852
8,591,258 B2 11/2013 Xiao et al.
10,218,105 B2 * 2/2019 Stange ..... H01R 13/22
2014/0287633 A1 9/2014 Ahangar et al.
2017/0093069 A1 3/2017 Koyama
2020/0395700 A1 12/2020 Pavlovic et al.

FOREIGN PATENT DOCUMENTS

CN 1930741 B 7/2010
CN 201750281 U 2/2011
CN 102265463 A 11/2011
(Continued)

*Primary Examiner* — Ross N Gushi

(74) *Attorney, Agent, or Firm* — Birch, Stewart, Kolasch & Birch, LLP

(57) ABSTRACT

The embodiments of the present disclosure provide an electrical connecting assembly and an electrical connector. The electrical connecting assembly comprises two electrical connecting parts and a connecting part. Each of the electrical connecting parts comprises a main body comprising an electrical contacting component. The connecting part comprises a securing component. Two sides of the connecting part extend toward one direction and are connected with the two electrical connecting parts. The two electrical connecting parts are disposed symmetrically across the connecting part. A first electrical connector head comprises an electrical plugging member and the electrical connecting assembly assembled to the electrical plugging member. A second electrical connector head comprises an electrical connecting notch in which the electrical plugging member having the electrical connecting assembly is assembled. The electrical contacting component of the electrical connecting assembly abuts against two inner sidewall surfaces of the electrical connecting notch.

16 Claims, 9 Drawing Sheets

(56) References Cited

FOREIGN PATENT DOCUMENTS

| | | | |
|---|---|---|---|
| CN | 203351869 | U | 12/2013 |
| CN | 103579806 | A | 2/2014 |
| CN | 104716540 | A | 6/2015 |
| CN | 106486791 | A | 3/2017 |
| CN | 106486806 | A | 3/2017 |
| CN | 106785570 | A | 5/2017 |
| CN | 108011247 | A | 5/2018 |
| CN | 108598739 | A | 9/2018 |
| CN | 110233375 | A | 9/2019 |
| CN | 209461665 | U | 10/2019 |
| CN | 110416779 | A | 11/2019 |
| CN | 209747767 | U | 12/2019 |
| CN | 110957597 | A | 4/2020 |
| CN | 111653888 | A | 9/2020 |
| CN | 211605458 | U | 9/2020 |
| CN | 112242625 | A | 1/2021 |
| CN | 212751213 | U | 3/2021 |
| DE | 100 14 116 | A1 | 9/2001 |
| EP | 1 089 387 | A2 | 4/2001 |
| EP | 1 428 297 | B1 | 3/2007 |
| EP | 3 136 516 | A1 | 3/2017 |
| JP | 3-291874 | A | 12/1991 |
| JP | 6-325813 | A | 11/1994 |
| JP | 2005-505104 | A | 2/2005 |
| JP | 2016-143665 | A | 8/2016 |
| KR | 10-2013-0027298 | A | 3/2013 |

* cited by examiner

ELECTRICAL CONNECTING ASSEMBLY AND ELECTRICAL CONNECTOR

CROSS-REFERENCE TO RELATED APPLICATION

This application claims the priority benefit of Chinese Patent Application Serial Number 202110578586.X, filed on May 26, 2021, the full disclosure of which is incorporated herein by reference.

BACKGROUND

Technical Field

The present disclosure relates to the technical field of connector, particularly to an electrical connecting assembly and an electrical connector.

Related Art

In the technical field of automotive industry, the operation of vehicles would affect the electrical conduction terminals for electrical connections in high-power electrical connector components. The operation of the vehicle would cause resonance of components of the electrical connector connected with male part and female part of the electrical connection. The service life of electrical connectors can be seriously affected by heat generated during electric conduction between the male part and the female part of the electrical connection, or fatigue and wear-deteriorated elastic metal sheets of electrical joints of heavily used vehicles that the electrical joints are often affected by heat or cold. Thus, the system stability of the equipment connected with electrical connectors is lowered, the service life of the equipment is shortened, and the risk that the equipment is facing is increased.

SUMMARY

The embodiments of the present disclosure provide an electrical connecting assembly and an electrical connector tended to solve the problem that conventional electrical joints are affected by cold or heat to cause fatigue and wear-deterioration to the elastic metal sheets, which leads to seriously affected or shortened service life.

On the first aspect, the present disclosure provides an electrical connecting assembly, comprising two electrical connecting parts and a connecting part. Each of the electrical connecting parts comprises a main body comprising an electrical contacting component. The connecting part comprises a securing component. Two sides of the connecting part extend toward one direction and are connected with the two electrical connecting parts. The two electrical connecting parts are disposed symmetrically across the connecting part.

In one embodiment, the electrical contacting component comprises an orifice part, a plurality of first contacting pieces, and a plurality of second contacting pieces. The plurality of first contacting pieces and the plurality of second contacting pieces are alternately disposed at the orifice part.

In one embodiment, the orifice part comprises a first side edge and a second side edge opposite to the first side edge. One ends of the plurality of first contacting pieces are respectively connected with the first side edge at intervals. One ends of the plurality of second contacting pieces are respectively connected with the second side edge at intervals. The plurality of first contacting pieces and the plurality of second contacting pieces are alternately arranged to form a staggered type component.

In one embodiment, one extending ends of the plurality of first contacting pieces comprise a bent contacting part. One extending ends of the plurality of second contacting pieces comprises a bent contacting part.

In one embodiment, an acute angle is formed between the plurality of first contacting pieces and a plane of the orifice part. An acute angle is formed between the plurality of second contacting pieces and a plane of the orifice part.

In one embodiment, the two electrical connecting parts and the connecting part are integrally formed.

In one embodiment, a plurality of guiding contact pieces are provided to be disposed at one side of the main body close to the connecting part.

In one embodiment, each of the guiding contact pieces comprises two abutting pieces extending in a direction away from the connecting part. A gap exists between the two abutting pieces.

In one embodiment, a plurality of first limiting members are provided to be disposed at one side of the main body close to the connecting part. Each of the limiting members are disposed in the gap.

In one embodiment, a plurality of second limiting members are provided to be disposed on two side edges of the main body.

In one embodiment, a plurality of electrical connecting points are provided to be disposed at the main body.

On the second aspect, the present disclosure provides an electrical connector comprising a first electrical connector head. The first electrical connector head comprising an electrical plugging member and the electrical connecting assembly according to the first aspect. The electrical connecting assembly is assembled to the electrical plugging member. The securing component is secured to the electrical plugging member. Wherein a second electrical connector head is provided to comprise an electrical connecting notch in which the electrical plugging member having the electrical connecting assembly is assembled. The electrical contacting component of the electrical connecting assembly abuts against two inner sidewall surfaces of the electrical connecting notch.

In one embodiment, the securing component is a securing hole. One end of the electrical plugging member comprises a securing bump embedded in the securing hole.

In one embodiment, a securing assembly is provided. The securing assembly comprises a first securing frame and two second securing frames adjacent to the first securing frame. The first securing frame is provided with an orifice. The securing assembly is assembled to the electrical plugging member having the electrical connecting assembly. The securing bump is embedded in the orifice. The first securing frame is secured to the connecting part.

In one embodiment, the electrical connecting notch of the second electrical connector head comprises a first opening and two second openings adjacent to the first opening. The first opening is communicating with the two second openings. The electrical plugging member having the electrical connecting assembly is assembled on its one end having the securing component in a direction facing the first opening or the two second openings. Wherein the first electrical connector head is assembled to the second electrical connector head in an angle of 180 degrees or 90 degrees.

In one embodiment, the electrical plugging member comprises a first limiting groove. The electrical connecting assembly further comprises a plurality of first limiting members embedded in the first limiting groove.

In one embodiment, two sides of the electrical plugging member are respectively provided with a second limiting groove. The electrical connecting assembly further comprises a plurality of second limiting members embedded in the second limiting groove.

In one embodiment, the electrical connecting assembly further comprises a plurality of electrical connecting points. The plurality of electrical connecting points abut against two side surfaces of the electrical plugging member.

In the embodiments of the present disclosure, the first electrical connector head comprises an electrical connecting assembly and an electrical plugging member. The electrical connecting assembly is assembled to the electrical plugging member. The second electrical connector head comprises an electrical connecting notch in which the electrical plugging member having the electrical connecting assembly is inserted. The electrical contacting component of the electrical connecting assembly abuts against the two inner wall surfaces of the electrical connecting notch. In this way, through the configuration of the electrical connecting assembly, it is possible to distribute the heat generated by the electric current overloading on the first electrical connector head and the second electrical connector head to reduce the heat generated by corrosion potential and to improve the overall current overload capacity. Thus, the overall service life for electrical connectors can be increased. Besides, the strength of the connection between the first electrical connector head and the second electrical connector head and the stability of the electrical contact can be enhanced by the structural configuration of the electrical connecting assembly.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
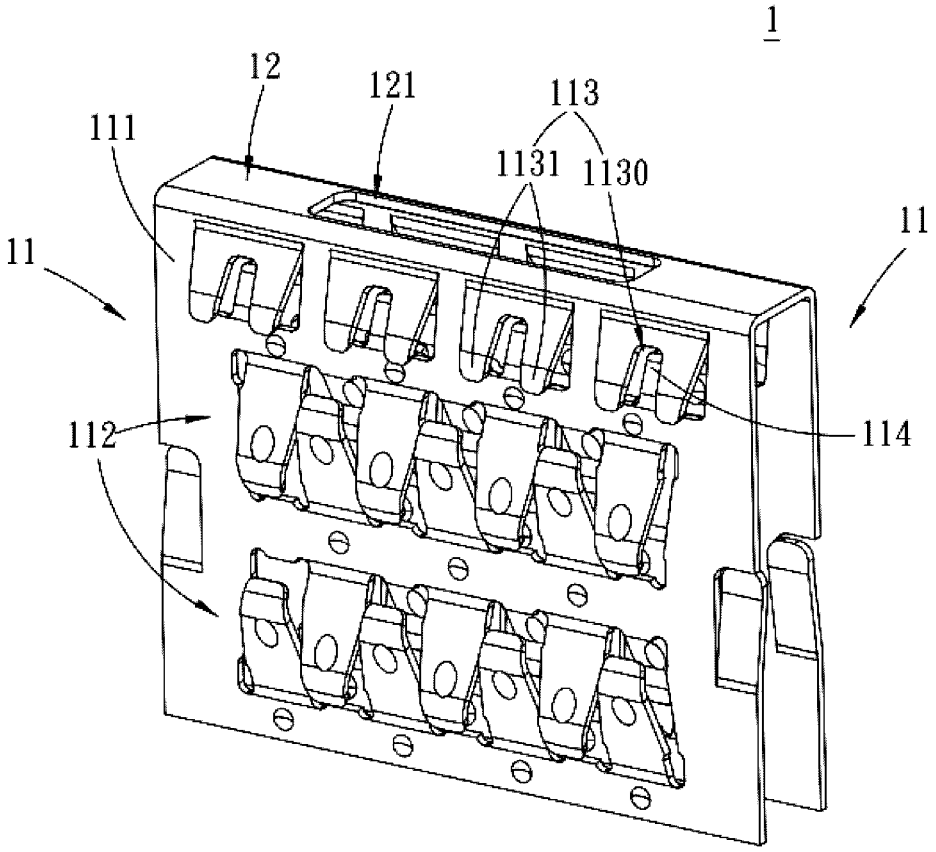
FIG. 1 is a perspective view of an electrical connecting assembly of the present disclosure.

FIG. 1 is a perspective view of an electrical connecting assembly of the present disclosure. As shown in the figure, in this embodiment, an electrical connecting assembly 1 is provided, which comprises two electrical connecting parts 11 and a connecting part 12. Each of the electrical connecting parts 11 comprises a main body 111 comprising an electrical contacting component 112. The connecting part 12 comprises a securing component 121. Two sides of the connecting part 12 extend in one direction and connect with two electrical connecting parts 11. The two electrical connecting parts 11 are symmetrically disposed across the connecting part 12. Wherein, the two electrical connecting parts 11 and the connecting part 12 are integrally formed so that the overall configuration of the electrical connecting assembly 1 is U-shaped.

Figure 2:
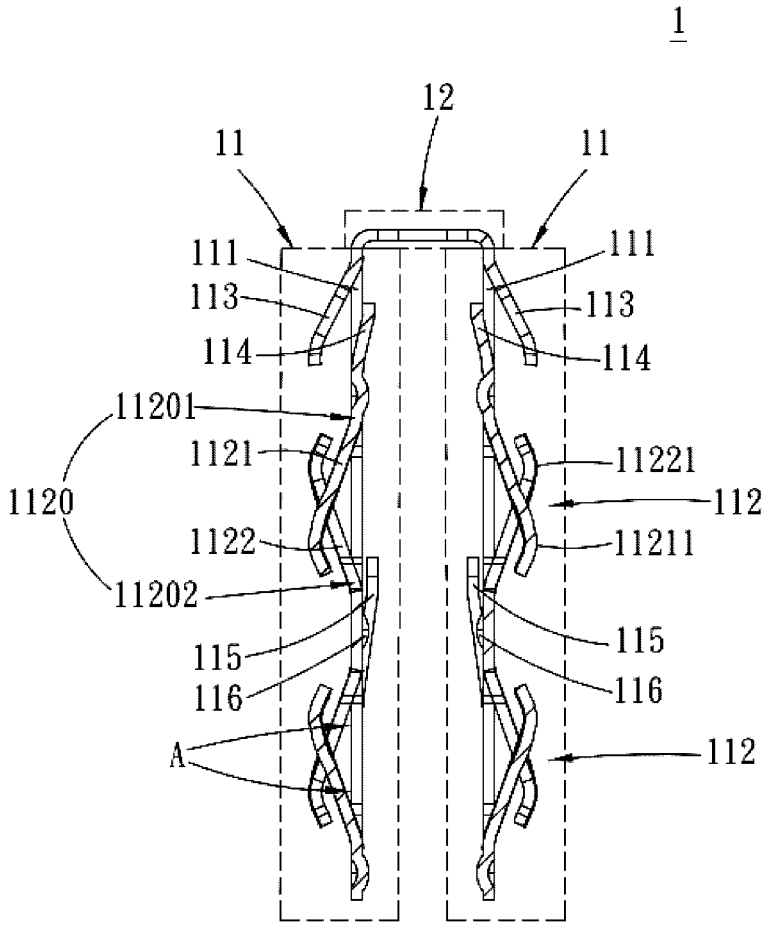
FIG. 2 is a side view of the electrical connecting assembly of the present disclosure.
Figure 3:
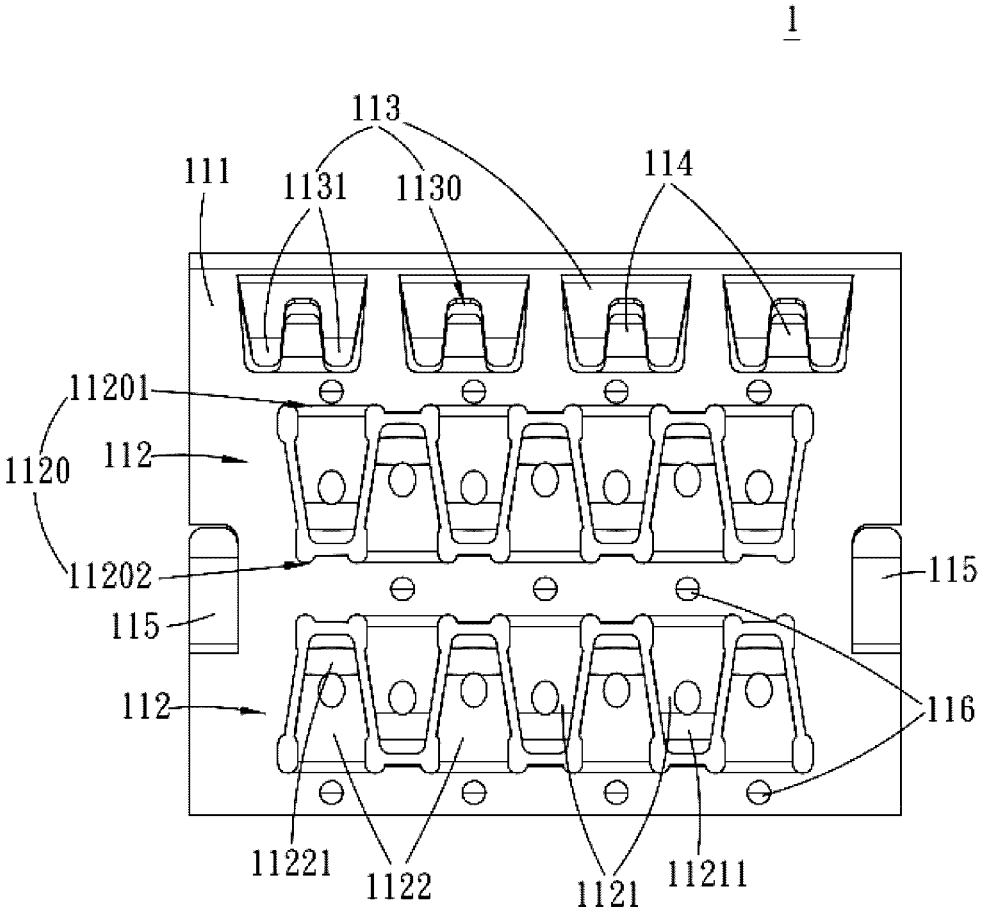
FIG. 3 is a front view of the electrical connecting assembly of the present disclosure.

FIG. 2 and FIG. 3 are side view and front view of the electrical connecting assembly of the present disclosure. As shown in the figures, in this embodiment, the electrical contacting component 112 comprises an orifice part 1120, a plurality of first contacting pieces 1121, and a plurality of second contacting pieces 1122. The plurality of first contacting pieces 1121 and a plurality of second contacting pieces 1122 are alternately disposed at the orifice part 1120. Wherein, the orifice part 1120 comprises a first side edge 11201 and a second side edge 11202 opposite to the first side edge 11201. One ends of the plurality of first contacting pieces 1121 are respectively connected with the first side edge 11201 at intervals. One ends of the plurality of second contacting pieces 1122 are respectively connected with the second side edge 11202 at intervals.

The plurality of first contacting pieces 1121 extend from the first side edge 11201 toward the second side edge 11202 and toward a direction away from one side having the connecting part 12. One extending ends of the plurality of first contacting pieces 1121 comprises a bent contacting part 11211. The plurality of second contacting pieces 1122 extend from the second side edge 11202 toward the first side edge 11201 and toward a direction away from one side having the connecting part 12. One extending ends of the plurality of second contacting pieces 1122 comprises a bent contacting part 11211. In this way, the plurality of first contacting pieces 1121 and the plurality of second contacting pieces 1122 form a staggered type component.

Besides, the plurality of first contacting pieces 1121 extend from the first side edge 11201 toward one side having the connecting part 12. An acute angle A is formed between the plurality of first contacting pieces 1121 and a plane of the orifice part 1120, and an acute angle A is formed between the plurality of second contacting pieces 1122 and a plane of the orifice part 1120.

In this embodiment, the electrical connecting assembly 1 further comprises a plurality of guiding contact pieces 113 disposed at one side of the main body 111 close to the connecting part 12. The plurality of guiding contact pieces 113 are formed by stamping the sheet metal at one side away from the connecting part 12 of the main body 111 to be M-shaped. That is, each of the guiding contact pieces 113 comprises two abutting pieces 1131 extending in a direction away from the connecting part 12. A gap 1130 exists between the two abutting pieces 1131.

The electrical connecting assembly 1 further comprises a plurality of first limiting members 114 disposed at one side of the main body 111 close to the connecting part 12. Each of the first limiting members 114 is disposed in the gap 1310. The electrical connecting assembly 1 further comprises a plurality of second limiting members 115 disposed at two side edges of the main body 111. The plurality of first limiting members 114 and the plurality of second limiting members 115 are formed by stamping the sheet metal at one side of the main body 111 having the connecting part 12. Besides, the electrical connecting assembly 1 further comprises a plurality of electrical connecting points 116 disposed at the main body 111. The plurality of electrical connecting points 116 are formed by stamping the sheet metal at one side of the main body 111 having the connecting part 12.

Figure 4:
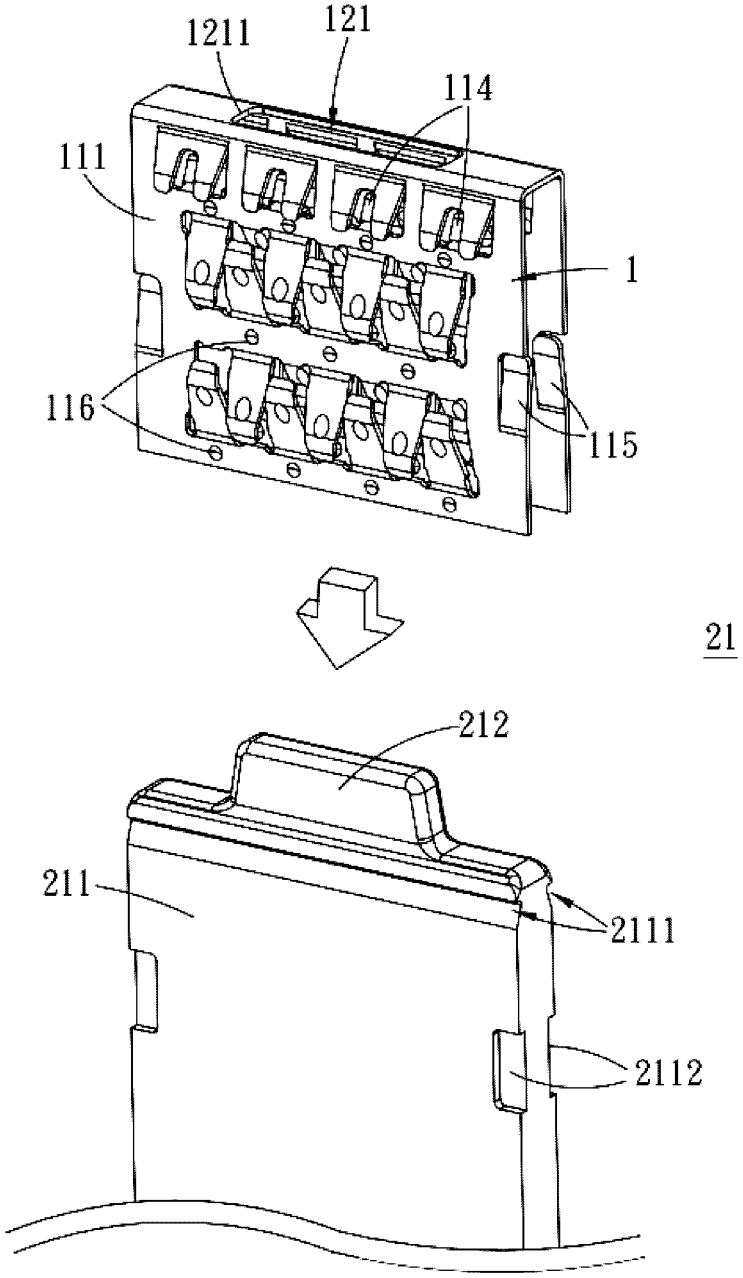
FIG. 4 shows the assembly of the electrical connecting assembly and a first electrical connector head of the present disclosure.

FIG. 4 shows the assembly of the electrical connecting assembly and a first electrical connector head of the present disclosure. As shown in the figure, in this embodiment, the first electrical connector head 21 comprises an electrical plugging member 211 and an electrical connecting assembly 1 assembled to the electrical plugging member 211. The securing component 121 is secured to the electrical plugging member 211. Where in the securing component 121 is a securing hole 1211, one end of the electrical plugging member 211 is provided with a securing bump 212 inserted in the securing hole 1211.

Besides, when the electrical connecting assembly 1 is assembled to the electrical plugging member 211, the electrical plugging member 211 would comprise a first limiting groove 2111, and the plurality of first limiting members 114 are embedded in the first limiting groove 2111. Two sides of the electrical plugging member 211 are provided with a second limiting groove 2112 in which the plurality of second limiting members 115 are embedded. The plurality of first limiting members 114 and the plurality of second limiting members 115 could prevent the electrical connecting assembly 1 from detaching from the electrical plugging member 211.

Furthermore, the plurality of electrical connecting points 116 of the electrical connecting assembly 1 abut against two side surfaces of the electrical plugging member 211. The electrical connecting assembly 1 is in contact with the two side surfaces of the electrical plugging member 211 through a plurality of electrical connecting points 116 to form a plurality of electrical connections.

Figure 5:
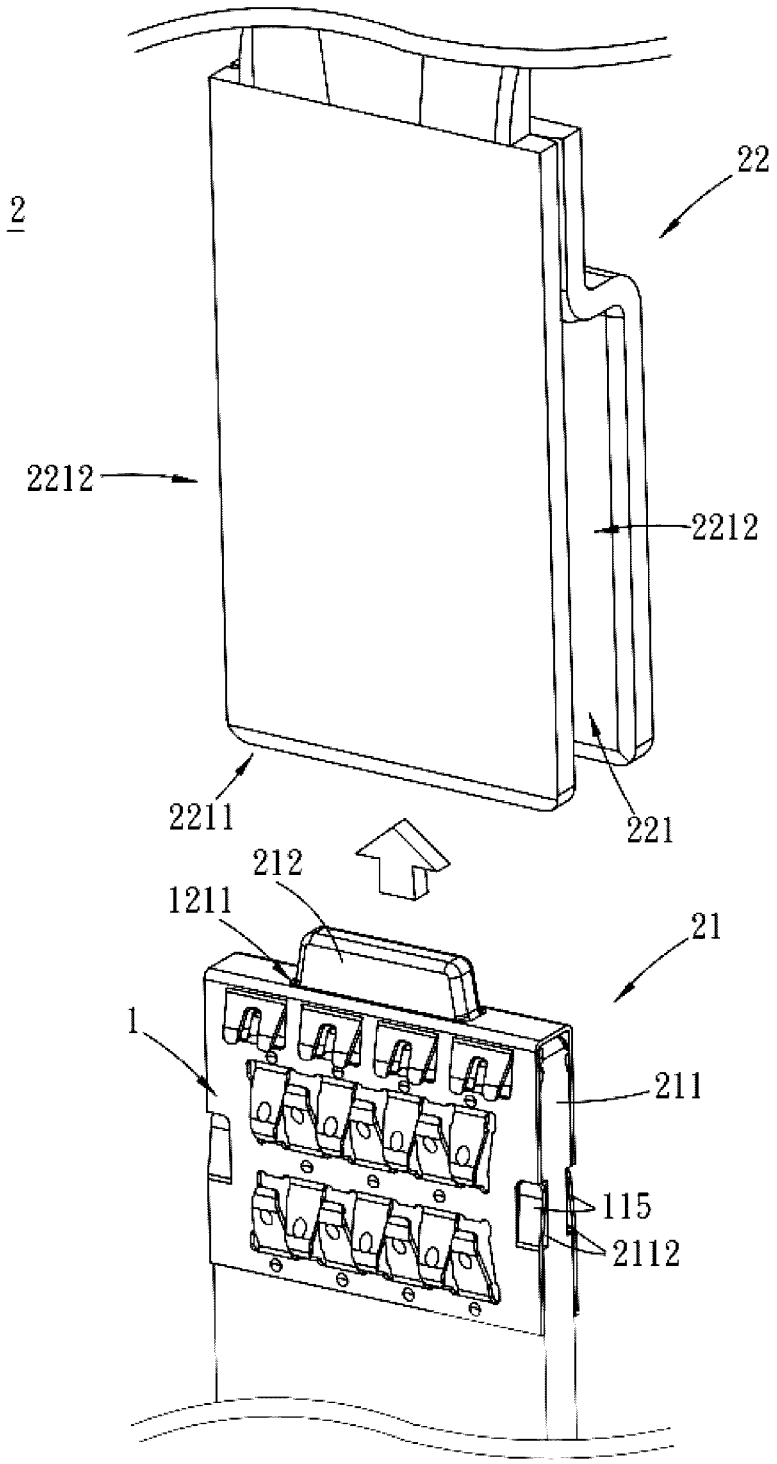
FIG. 5 shows the assembly of an electrical connector of the present disclosure.
Figure 6:
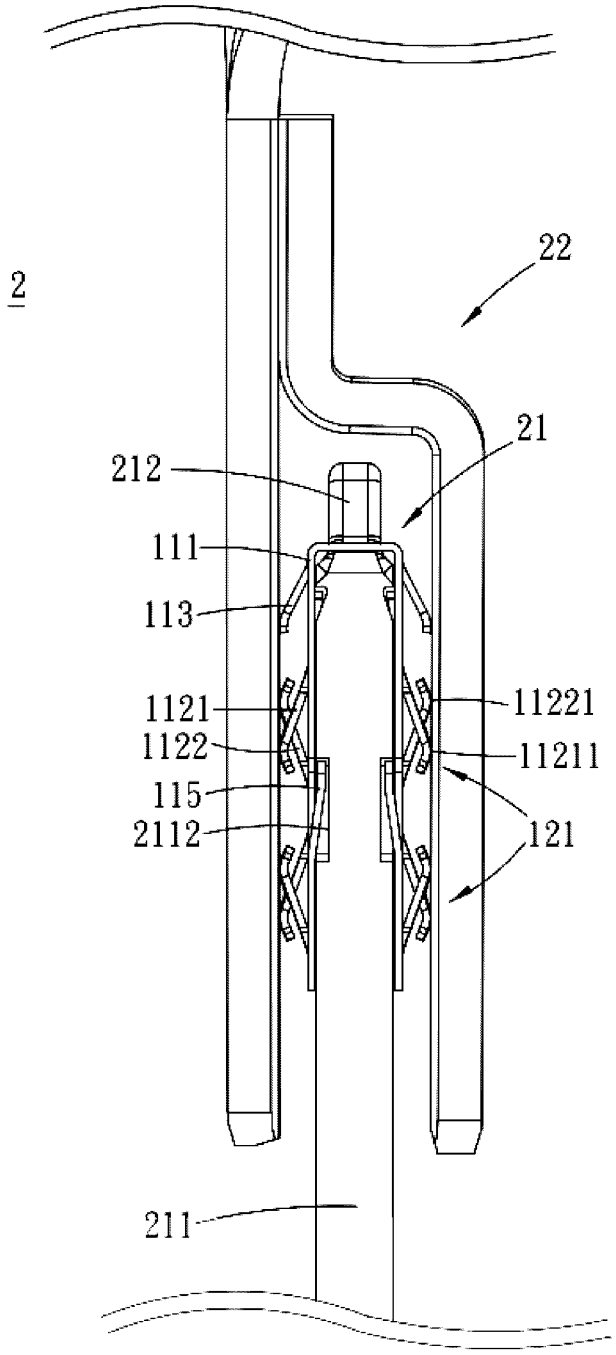
FIG. 6 is a side view of the electrical connector of the present disclosure.

FIG. 5 shows the assembly of an electrical connector of the present disclosure. FIG. 6 is a side view of the electrical connector of the present disclosure. As shown in the figures, in this embodiment, an electrical connector 2 is provided, which comprises a first electrical connector head 21 and a second electrical connector head 22 connected with the first electrical connector head 21. Wherein, the second electrical connector head 22 comprises an electrical connecting notch 221 in which the electrical plugging member 211 having the electrical connecting assembly 1 is assembled. The electrical contacting component 112 of the electrical connecting assembly 1 abuts against two inner sidewalls of the electrical connecting notch 221.

In this embodiment, the electrical plugging member 211 can be guided along the direction of a plurality of guiding contact pieces 113 of the electrical connecting assembly 1, so that the electrical plugging member 211 can be assembled into the electrical connecting notch 221 without obstruction. Moreover, when the electrical plugging member 211 having the electrical connecting assembly 1 is assembled in the electrical connecting notch 221, the angle A between the plurality of first contacting pieces 1121 and the plurality of second contacting pieces 1122 and the orifice part 1120 would affect the tightness of the assembly of the electrical plugging member 211 in the electrical connecting notch 221, which indicates the abutting force that the bent contacting part 11211 of the plurality of first contacting pieces 1121 and the bent contacting part 11221 of the plurality of second contacting pieces 1122 relatively abutting against an inner wall of the electrical connecting notch 221. Wherein, when the angle A of the first contacting pieces 1121 and the angle A of the second contacting pieces 1122 are increasing, the abutting force of the bent contacting part 11211 of the plurality of first contacting pieces 1121 and of the bent contacting part 11221 of the plurality of second contacting pieces 1122 relative to the inner wall would be increasing accordingly. By adjusting the angle between the plurality of first contacting pieces 1121 and the orifice part 1120 and the angle between the plurality of second contacting pieces 1122 and the orifice part 1120, the assembly strength of the electrical plugging member 211 assembled in the electrical connecting notch 221 can be increased.

What needs to be further explained is that, through the disposing of the plurality of guiding contact pieces 113 at one side close to the connecting part 12 with alternate arrangement of the plurality of first contacting pieces 1121 and the plurality of second contacting pieces 1122, the electrical plugging member 211 can be stably assembled in the electrical connecting notch 221 by using the configuration of the plurality of first contacting pieces 1121, a plurality of second contacting pieces 1122, and a plurality of guiding contact pieces 113 and by elastically abutting against the two inner sidewalls of the electrical connecting notch 221 when assembled in the electrical connecting notch 221.

Figure 7:
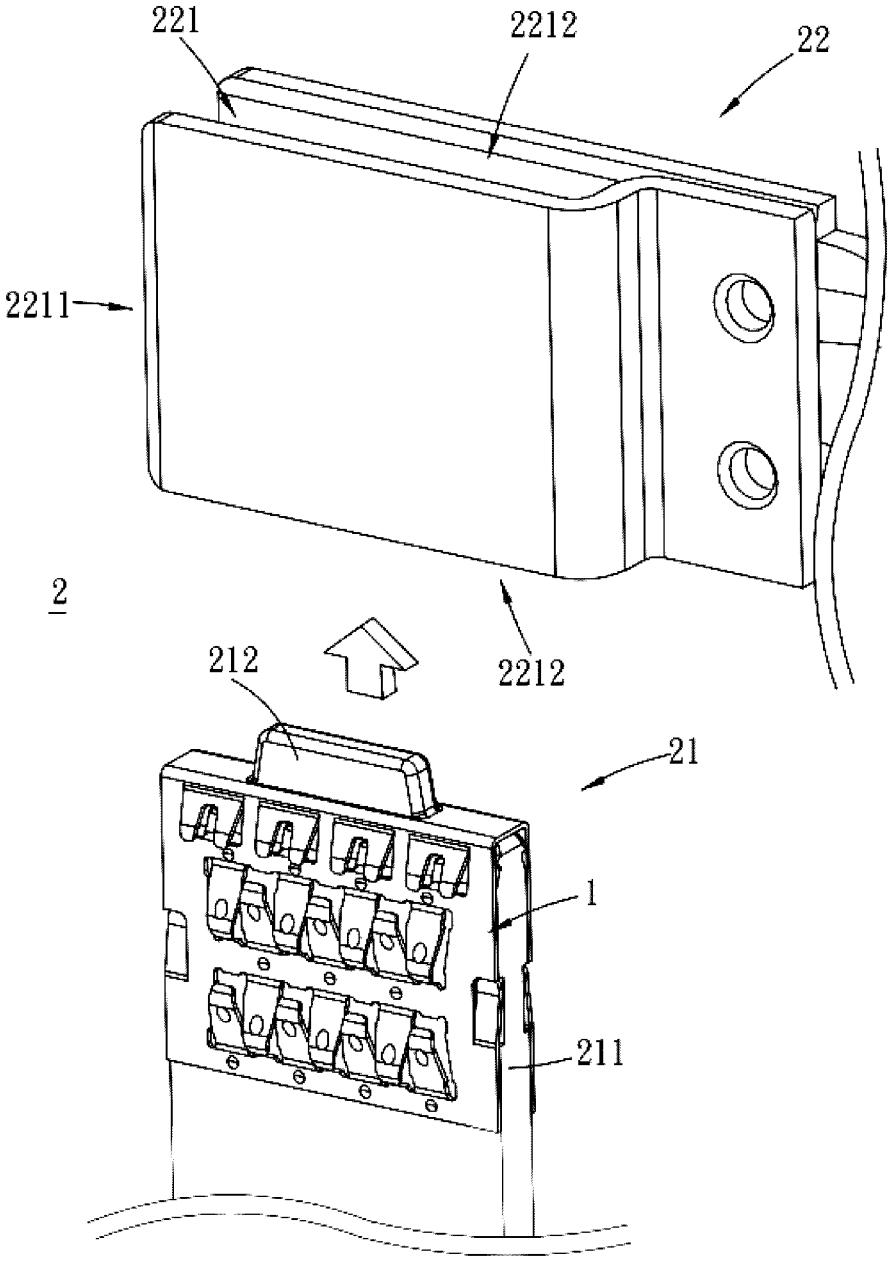
FIG. 7 shows another type of assembly of an electrical connector of the present disclosure.

FIG. 7 shows another type of assembly of an electrical connector of the present disclosure. As shown in the figure, in this embodiment, the electrical connecting notch 221 of the second electrical connector head 22 comprises a first opening 2211 and two second openings 2212 adjacent to the first opening 2211. The first opening 2211 is communicating with the two second openings 2212. The electrical plugging member 211 having the electrical connecting assembly 1 is assembled on its one end having the securing component 121 in a direction facing the two second openings 2212. Wherein, the first electrical connector head 21 is assembled to the second electrical connector head 22 in an angle of 90 degrees. That is, the second electrical connector head 22 is disposed horizontally relative to one end of the electrical plugging member 211, and the electrical plugging member 211 is straightly inserted, presenting a right-angled assembly.

Referring to FIG. 6 again, the electrical plugging member 211 having the electrical connecting assembly 1 is facing the first opening 2211 on its one end having the securing component 121. Wherein, the first electrical connector head 21 is assembled to the second electrical connector head 22 in an angle of 180 degrees, indicating that the electrical plugging member 211 is straightly assembled into the second electrical connector head 22.

Figure 8:
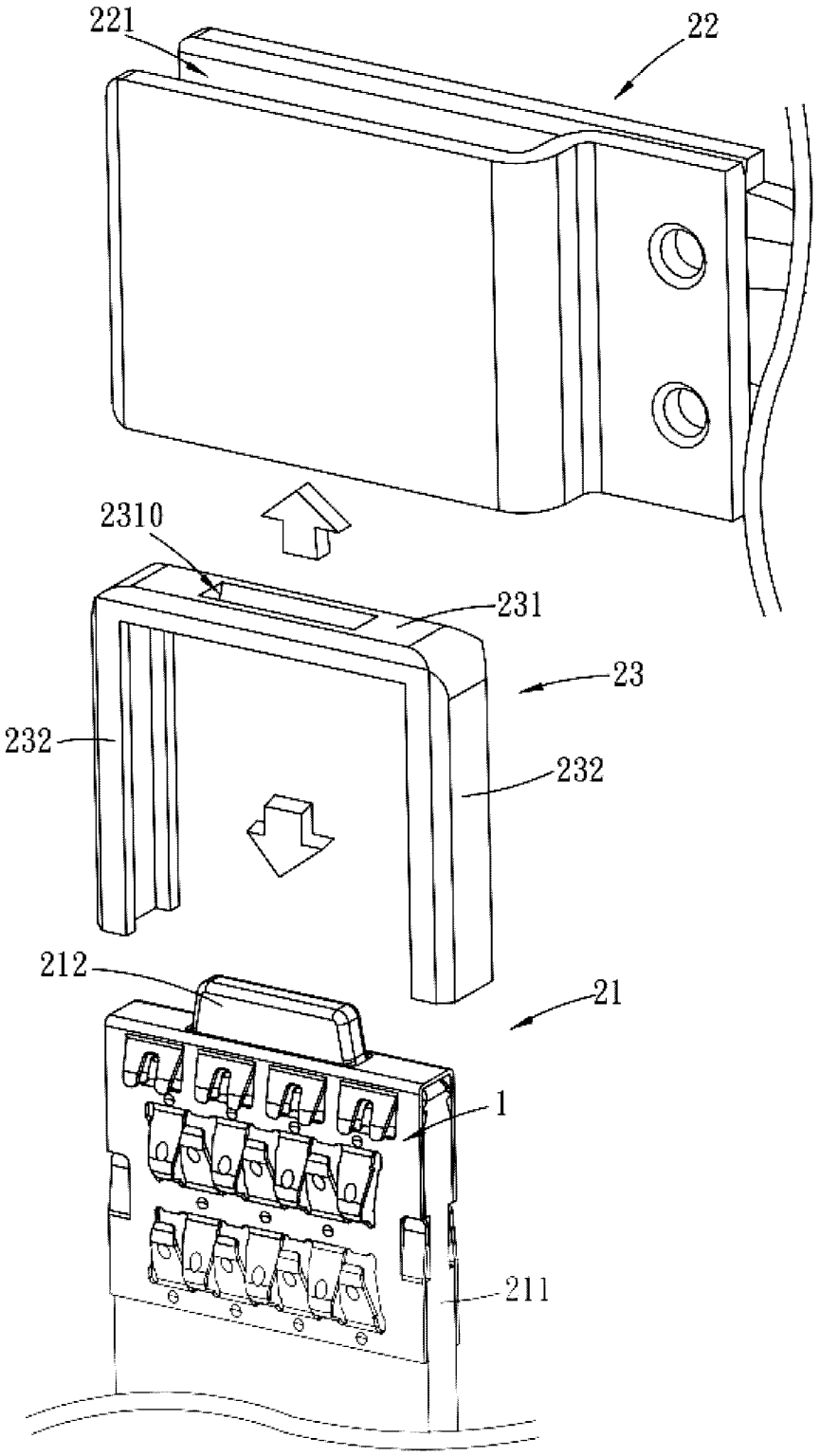
FIG. 8 shows the assembly of the electrical connector and a securing assembly of the present disclosure.
Figure 9:
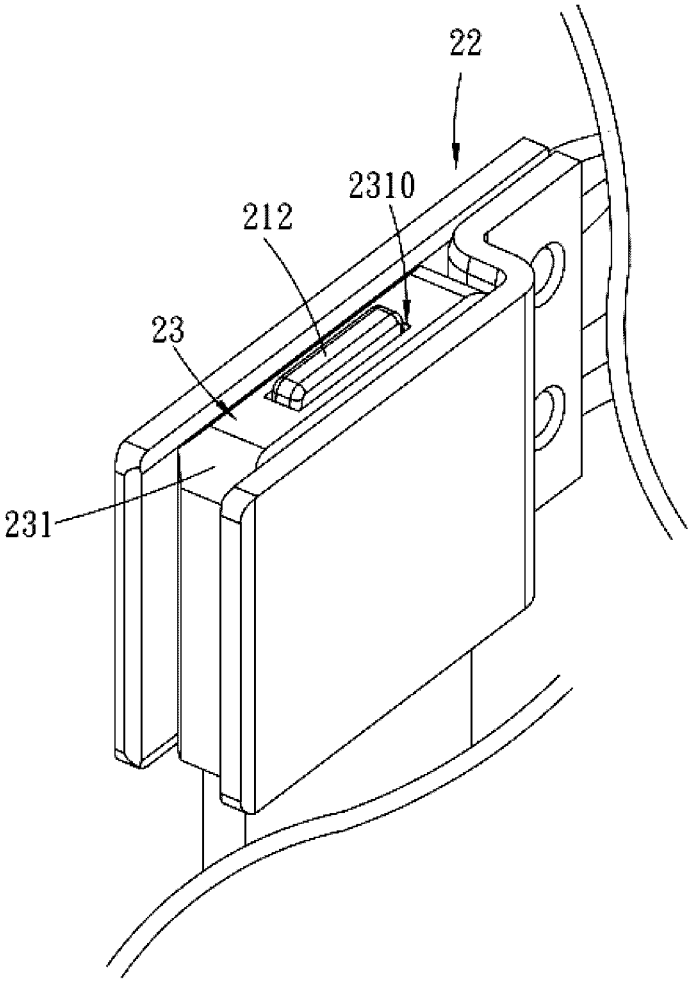
FIG. 9 is a perspective view of the electrical connector and a securing assembly of the present disclosure.

FIG. 8 shows the assembly of the electrical connector and a securing assembly of the present disclosure. FIG. 9 is a perspective view of the electrical connector and a securing assembly of the present disclosure. As shown in the figures, in this embodiment, the electrical connector 2 further comprises a securing assembly 23 comprising a first securing frame 231 and two second securing frames 232 adjacent to the first securing frame 231. The first securing frame 231 comprises an orifice 2310. The securing assembly 23 is assembled to the electrical plugging member 211 having the electrical connecting assembly 1. A securing bump 212 is embedded in the orifice 2310. The first securing frame 231 is secured to the connecting part 12, and the two second securing frames are secured to the two sides of the electrical plugging member 211 without the two electrical connecting parts 11. Wherein the securing assembly 23 could secure the electrical connecting assembly 1 onto the electrical plugging member 211. Furthermore, the electrical plugging member 211 having the securing assembly 23 can be assembled in an electrical connecting notch 221, and the securing assembly 23 can be contactingly secured to an inner wall of the electrical connecting notch 221 to increase the assembly strength between the electrical plugging member 211 and the electrical connecting notch 221.

In summary, embodiments of the present disclosure provide an electrical connecting assembly and an electrical connector. the first electrical connector head comprises an electrical connecting assembly and an electrical plugging member. The electrical connecting assembly is assembled to the electrical plugging member. The second electrical connector head comprises an electrical connecting notch in which the electrical plugging member having the electrical connecting assembly is inserted. The first electrical connector head is connected with the second electrical connector head. The electrical contacting component of the electrical connecting assembly abuts against the two inner wall surfaces of the electrical connecting notch. In this way, it is possible to distribute the heat generated by the electric current overloading on the first electrical connector head and the second electrical connector head to reduce the heat generated by corrosion potential and to improve the overall current overload capacity. Thus, the overall service life for electrical connectors can be increased, and the strength of the connection between the first electrical connector head and the second electrical connector head and the stability of the electrical contact can be enhanced.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connecting assembly, comprising:

two electrical connecting parts, each of which comprising a main body comprising an electrical contacting component;

a connecting part comprising a securing component, two sides of the connecting part extending toward one direction and connecting with the two electrical connecting parts, the two electrical connecting parts being disposed symmetrically across the connecting part; and a plurality of guiding contact pieces disposed at one side of each of the main body close to the connecting part, wherein each of the guiding contact pieces comprises two abutting pieces extending in a direction away from the connecting part; a gap exists between the two abutting pieces.

2. The electrical connecting assembly according to claim 1, wherein each of the electrical contacting component comprises an orifice part, a plurality of first contacting pieces, and a plurality of second contacting pieces; the plurality of first contacting pieces and the plurality of second contacting pieces are alternately disposed at the orifice part.

3. The electrical connecting assembly according to claim 2, wherein each of the orifice part comprises a first side edge and a second side edge opposite to the first side edge; one ends of the plurality of first contacting pieces are respectively connected with the first side edge at intervals; one ends of the plurality of second contacting pieces are respectively connected with the second side edge at intervals; the plurality of first contacting pieces and the plurality of second contacting pieces are alternately arranged to form a stagger type component.

4. The electrical connecting assembly according to claim 3, wherein one extending ends of the plurality of first contacting pieces comprises a bent contacting part; one extending ends of the plurality of second contacting pieces comprises a bent contacting part.

5. The electrical connecting assembly according to claim 3, wherein an acute angle is formed between the plurality of first contacting pieces and a plane of the orifice part; an acute angle is formed between the plurality of second contacting pieces and a plane of the orifice part.

6. The electrical connecting assembly according to claim 1, wherein the two electrical connecting parts and the connecting part are integrally formed.

7. The electrical connecting assembly according to claim 1 comprising a plurality of first limiting members disposed at one side of the main body close to the connecting part, each of the limiting members being disposed in the gap.

8. The electrical connecting assembly according to claim 1 comprising a plurality of second limiting members disposed on two side edges of each of the main body.

9. The electrical connecting assembly according to claim 1 comprising a plurality of electrical connecting points disposed at the main body.

10. An electrical connector, comprising:

a first electrical connector head comprising an electrical plugging member and the electrical connecting assembly, the electrical connecting assembly being assembled to the electrical plugging member, the securing component being secured to the electrical plugging member, the electrical connecting assembly comprising:

two electrical connecting parts, each of which comprising a main body comprising an electrical contacting component; and a connecting part comprising a securing component, two sides of the connecting part extending toward one direction and connecting with the two electrical connecting parts, the two electrical connecting parts being disposed symmetrically across the connecting part;

wherein a second electrical connector head is provided to comprise an electrical connecting notch in which the electrical plugging member having the electrical connecting assembly is assembled; the electrical contacting component of the electrical connecting assembly abuts against two inner sidewall surfaces of the electrical connecting notch.

11. The electrical connector according to claim 10, wherein the securing component is a securing hole; one end of the electrical plugging member comprises a securing bump embedded in the securing hole.

12. The electrical connector according to claim 11 comprising a securing assembly comprising a first securing frame and two second securing frames adjacent to the first securing frame, the first securing frame being provided with an orifice, the securing assembly being assembled to the electrical plugging member having the electrical connecting assembly, the securing bump being embedded in the orifice, the first securing frame being secured to the connecting part.

13. The electrical connector according to claim 10, wherein the electrical connecting notch of the second electrical connector head comprises a first opening and two second openings adjacent to the first opening; the first opening is communicating with the two second openings; the electrical plugging member having the electrical connecting assembly is assembled on its one end having the securing component in a direction facing the first opening or the two second openings; wherein the first electrical connector head is assembled to the second electrical connector head in an angle of 180 degrees or 90 degrees.

14. The electrical connector according to claim 10, wherein the electrical plugging member comprises a first limiting groove; the electrical connecting assembly further comprises a plurality of first limiting members embedded in the first limiting groove.

15. The electrical connector according to claim 10, wherein two sides of the electrical plugging member are respectively provided with a second limiting groove; the electrical connecting assembly further comprises a plurality of second limiting members embedded in the second limiting groove.

16. The electrical connector according to claim 10, wherein the electrical connecting assembly further comprises a plurality of electrical connecting points; the plurality of electrical connecting points abut against two side surfaces of the electrical plugging member.

* * * * *